US005324040A

United States Patent [19]

Panda

[11] Patent Number: 5,324,040

[45] Date of Patent: Jun. 28, 1994

[54] METHOD OF PLAYING A BOARD GAME BY FORMING A SEQUENCE OF WORDS FROM START TO FINISH

[76] Inventor: Rajenda D. Panda, 9-10 Merrit Ave., Fairview Gardens, Kingston, N.Y. 12401

[21] Appl. No.: 757,033

[22] Filed: Sep. 9, 1991

Related U.S. Application Data

[63] Continuation-in-part of Ser. No. 565,148, Aug. 10, 1990, abandoned.

[51] Int. Cl.[5] ..... A63F 3/00

[52] U.S. Cl. ..... 273/272; 273/258; 273/275

[58] Field of Search ..... 273/236, 242, 248, 258, 273/271, 272, 275, 299; 434/159, 160, 167

[56] References Cited

U.S. PATENT DOCUMENTS

| | | | |
|---|---|---|---|
| 485,029 | 10/1892 | Conkling . | |
| 526,373 | 9/1894 | Boyer . | |
| 2,232,055 | 2/1941 | Davis . | |
| 2,585,268 | 2/1952 | Olsen . | |
| 3,342,493 | 9/1967 | Lang | 273/272 |
| 3,472,514 | 10/1969 | Green | 273/272 |
| 4,190,255 | 2/1980 | Hughes | 273/272 |
| 4,190,256 | 2/1980 | Rudden | 273/275 |
| 4,555,116 | 11/1985 | Fields | 273/236 |
| 4,741,539 | 5/1988 | Sutton et al. | 273/275 |
| 5,058,896 | 10/1991 | Bez | 273/272 |

FOREIGN PATENT DOCUMENTS

| | | | |
|---|---|---|---|
| 1107303 | 12/1955 | France | 273/272 |
| 465979 | 5/1937 | United Kingdom | 273/258 |
| 2114898 | 9/1983 | United Kingdom | 273/275 |

OTHER PUBLICATIONS

"The Book of Games", by Richard Sharp and John Piggott (New York: Galahad Books), 1977, pp. 79 & 80.

*Primary Examiner*—Benjamin Layno
*Assistant Examiner*—William M. Pierce

[57] ABSTRACT

A method of playing a board game in which word chains are formed by opposing players and utilizing a playing board of general hexagonal configuration which is divided into contiguous hexagonal areas with the edges of the hexagonal configuration being one of two alternating colors and in which each player directs a word chain from the player's own side to either another side or other sides which attempting physically to obstruct the word chain of the opponent from reaching the opponent's designated side or sides.

6 Claims, 1 Drawing Sheet

METHOD OF PLAYING A BOARD GAME BY FORMING A SEQUENCE OF WORDS FROM START TO FINISH

RELATED APPLICATION

This application is a continuation-in-part of co-sending U.S. application, Ser. No. 07/565,148 filed Aug. 10, 1990, now abandoned.

BACKGROUND OF THE INVENTION

The present invention relates to a method of playing board games and more particularly to a method of playing a board game in which each of the players uses playing pieces with letters on them to form a chain of words.

Various board games have been developed, some using a board of general hexagonal configuration and some using playing pieces to form words. All of these various games have provided amusement and certain of them have been educational.

The present invention provides a board game which is both entertaining and educational and which also developes strategic skills not only in spelling and vocabulary, but in directing a word chain from one part of the board to the other both to extend a word chain from one player's side to another side or other sides while physically obstructing the word chain of the opponent player from reaching the opponent's designated side or sides.

The novel features which are considered as characteristic of the invention are set forth with particularity in the appending claims. The invention itself, however, as to its construction and obvious advantages will be best understood from the following description of the specific embodiment when read with the accompanying drawings.

SUMMARY OF THE INVENTION

The present invention provides a method of playing a board game utilizing a board of a general hexagonal configuration divided into continuous hexagonal areas herein called "inner hexagons". Alternate edges of the hexagonal configuration have one of two different colors. There are two sets of playing pieces. Each playing piece is hexagonal in shape and is sized to fit snugly in the hexagonal spaces of the game board. Each set of playing pieces is colored consistent with one of the two colors along alternate edges of the board.

The objective of the board game for each of the players is to form a word chain connecting one side of the board with another predetermined side or sides of the board by placing playing pieces on the inner hexagons. Two alternative approaches to playing are possible. In one approach, each player strives to build a word chain to the directly opposite side of the hexagonal board having the opposite color from which that player initiates play. In the alternative approach, each player strives to build a word chain with two branches both of which reach the remaining two sides of the board having the same color as the side from which that player initiates play.

DESCRIPTION OF THE DRAWINGS

The present invention may be better understood and its numerous advantages will be apparent to those skilled in the art by reference to the accompanying drawings, wherein like reference numerals refer to like elements in the various figures in which.

DETAILED DESCRIPTION OF THE INVENTION

Figures 1, 2, 3:
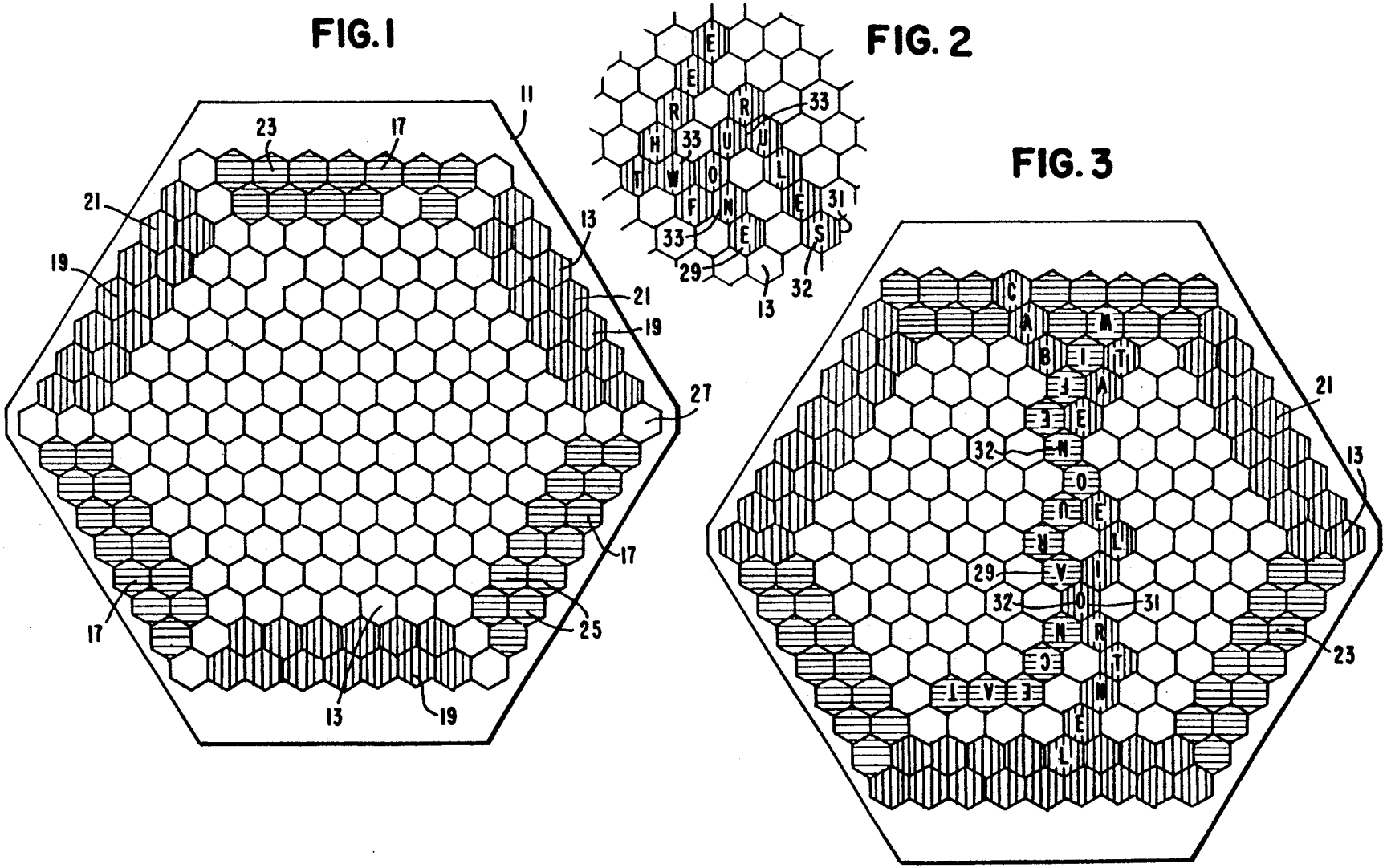
FIG. 1 is a plan view of the playing board showing the alternating colored edges, but without any playing pieces on the hexagonal board.
FIG. 2 is a plan view of a portion of the playing board showing playing pieces as placed on the playing board by only one player but showing the manner in which the playing pieces are used to form words diagonally along the inner hexagons and to show the formation of interlinking words.
FIG. 3 is a plan view of the playing board showing letters in place on the board as would exist with a completed game and showing words formed in a word chain by each of the two players with both chains extending to and from opposing sides each having letters of different color.

Referring now to FIG. 1, the playing board 11 is hexagonal and is completely subdivided into substantially equally-sized inner hexagons 13. In the preferred form of the playing board 11, each of the six outside edges 15 of the playing board 11 has twelve (12) inner hexagons and the total board has four hundred sixty-seven (467) inner hexagons 13. However, various sizes of playing boards 11 are envisioned for games of varying complexity and duration. The playing board 11 shown in FIGS. 1 and 3 is for a game of reduced size, such as would be used for travel, having eight inner hexagons 13 along each of six inside edges 15 with a total of two hundred seventeen (217) inner hexagons 13. Alternate edges of the playing board 11 are colored in one color 17 and the other alternate edges are colored in another color 19. Preferably three edges are colored red 21 and the three alternate edges are colored blue 23. As seen in both FIGS. 1 and 2, the two outermost rows 25 of inner hexagons 13 are colored with one of two selected colors 17, 19 with one inner hexagon 27 between separate edges left without color for each of the outermost rows 25 of inner hexagons 13.

In combination with the playing board 11, each player is assigned seventy five (75) playing pieces 29 with letters of the alphabet embossed thereon. As outside limits, each player is assigned a number of playing pieces 29 in the range of fifty playing pieces 29 to one hundred playing pieces 29. Preferably, the range of the number of playing pieces in each set of playing pieces would be in the range of sixty-five playing pieces to eighty-five playing pieces 29. The letters are colored to match one of the two colors 17, 19 used. One player preferably has a set of playing pieces 29 with blue letters and the other player has playing pieces 29 with red letters. Preferably, each playing piece 29 is white so as sharply to show the colored letter on it.

The distribution of letters on the playing pieces 29 provided to each player is as follows:

| LETTER | NUMBER OF PLAYING PIECES WITH THE LETTER |
|---|---|
| A | 6 |
| B | 2 |
| C | 2 |
| D | 3 |
| E | 9 |
| F | 2 |
| G | 2 |

-continued

| LETTER | NUMBER OF PLAYING PIECES WITH THE LETTER |
|---|---|
| H | 2 |
| I | 6 |
| J | 1 |
| K | 1 |
| L | 3 |
| M | 2 |
| N | 4 |
| O | 5 |
| P | 2 |
| Q | 1 |
| R | 4 |
| S | 3 |
| T | 4 |
| U | 3 |
| V | 2 |
| W | 2 |
| X | 1 |
| Y | 2 |
| Z | 1 |

If the number of playing pieces 29 is either increased or decreased, it is preferable to retain as close a ratio between the different letters on the playing pieces 29 as is stated for seventy-five playing pieces.

The playing pieces 29 must be selected at random and therefore are preferably kept in two opaque bags, but any container (not shown) may be used for preventing the player from seeing the playing pieces 29 in advance and thus being forced to select playing pieces 29 with the required number of letters at random.

Certain of the letters of the alphabet are given a special classification as bridge letters 31 and bridge letters 31 are distinguishable by having some mark on the playing piece 29, but preferably a circle 32 about the letter. The circle 32 is colored in the same color and manner as the bridge letter 31 itself. Only certain letters of the alphabet are designated as bridge letters 31 and those letters are I, 0, H, N, S, X and Z. The function of the playing pieces 29 with bridge letters 31, which is distinctive from the other playing pieces 29 having letters which are not bridge letters 31, is that each player may use the playing pieces 29 with bridge letters 31 already placed on the board by an opponent.

At the outset of a game, the players select opposite outside edges 15 of the playing board 11, one thus having a red side 21 and the other a blue side 23, assuming those being the colors used. The players will select which level or version of the game they wish to play.

In the simplest form, each player strives to build a word chain from his outside edge 15 of the playing board 11, to the directly opposite outside edge 15 of the playing board 11 which has a different color from the color where the player begins the game. More specifically, the two players each select opposite playing edges, one a red outside edge 21 and the other a blue outside edge 23. The player who initiates play at the red outside edge 21 strives to build a word chain to the blue outside edge 23 directly opposite from the red outside edge 21. Similarly, the other player who initiates play at the blue outside edge 23, which is the blue outside edge 23 where the player from the red outside edge 21 desires to finish, strives to build a word chain to the red outside edge 21 where the opponent has started play. The player who first forms a continuous word chain to the other player's outside edge 15 wins the game.

In the alternative game, each player strives to construct a word chain with two branches extending from the outside edge 15 of the playing board 11 where that player initiates play to the two remaining sides of the game board having the same colors. Just as in the version of the game previously described, one player starts at a blue outside edge 23 and the other player selects a red starting edge 21 opposite from the blue outside edge 23. In other words, the player starting at the red outside edge 21 of the playing board 11 will strive to form a word chain with two branches to reach each of the two other red outside edges 21 of the playing board 11. Similarly, the player who initiates play at the blue outside edge 23 will strive to form a word chain with two branches to reach each of the two other blue outside edges 23 of the game board 11. The player who first forms a continuous word chain that reaches the two remaining outside edges 15 of the same color as the color of the outside edge 15 where that player initiates play, wins the game.

The order of play, in both versions of the game, for the two players is decided by the toss of a die or coin. (not shown)

Each player in turn selects five playing pieces 29 at random from the playing pieces 29 provided to that player. In the very first turn, if all consonants or vowels are selected by a player, that player can select further playing pieces 29 as many times as needed, to get playing pieces 29 having a mixture of vowels and consonants but can never play with more than five playing pieces 29. A player can form in one turn, more than one word as long as the words formed are part of a continuous chain.

At the outset of each turn following the initial turn, a player may have only five playing pieces 29. These five playing pieces 29 may include playing pieces 29 remaining from the earlier turn of that same player along with an added number of playing pieces 29 selected at random or the player may return all or some of the unused playing pieces 29 from the prior turn and select new playing pieces 29 at random but never may the player have more than five playing pieces 29 at the onset of a turn.

Each player in the first turn of that player, places playing pieces to form a word either horizontally or along one of the two diagonals to occupy at least one of the inner hexagons 13 along that outside edge 15 where that player initiates play. Commencing with the second turn of that player and for each turn thereafter, each player places the playing pieces 29, selected at random, along one or more directions from at least one playing piece 29 which has already been placed on the playing board 11 by that player in order to form a word. The placement of playing pieces 29 in one direction to form a word may create interlinking words 33. The formation of any intended word, including but limited to the use of bridge letters 31 may result in the formation of interlinking words 33. Interlinking words 33 are unintended words created by the formation of intended words. If such unintended words are a combination of either all vowels or all consonants, they too must be considered as legitimate and need not be English language words. However, if such an interlinking word 33 is a combination of both vowels and consonants, then such interlinking word must be a legitimate English language word.

Legitimate English language words are those words which are listed in any regularly accepted dictionary except proper nouns, abbreviations, acronyms, prefixes and suffixes. Either player may challenge the legitimacy of a word formed by the other player, but only if the challenge is made immediately. If the challenger is proven correct then the opponent will have to remove the word as well as lose the next turn. If the challenger is proven wrong, then the challenger will lose the next turn. A dictionary may be consulted only upon a challenge.

Although words which may be placed on the board in any of the three possible directions, all words including interlinking words 33, must be read from left to right as viewed by each player of his own playing pieces 29. This rule is exemplified in FIG. 2 in which a portion of the word chain formed by only one player in five successive turns is shown. In five successive turns, the player formed the words "ONE", "TWO", "THREE", "FOUR", and "RULES". By forming these intended words the player also formed unintended interlinking words, FN, HWF and UU. These are also examples of interlinking words 33 that are either all consonants or all vowels and therefore are acceptable and need not be English language words. Should the interlinking word 33 be a combination of vowels and consonants, then such interlinking word must be an English language word or such attempted use of the bridge letter 31 must be abandoned.

A player can choose to use the opponent's bridge letters 31 to form the player's words. However, once the opponent's bridge letter 31 is utilized it will be treated as that player's own letter and should conform to all the rules of the game but the possible unintentional formation of interlinking words is an important exception within the rules.

In FIG. 3, the player designated as the blue color has created the word "once" using the bridge letter 31 "0" of the player designated by the red color. Note that the word "once" being a word of the player designated as blue reads from left to right as viewed by the player designated blue. Similarly, the player designated by the color red has created the word "bit" using the blue bridge letter 31 "i" but the word "bit" as viewed by the player designated red reads from left to right.

By forming the word "bit" the player designated as red has created the interlinking word "I A" but since both "I" and "A" are vowels, it is permitted. In the completed game show in FIG. 3, the player with playing pieces 29 designated red won the game by starting the player's word chain with the word "LENT" and ending it with the word "CAB" on the opposite side. The player also used, as shown in FIG. 3, some of the opponent's bridge letters 31 in extending the player's own word-chain.

If one player exhausts the entire supply of playing pieces 29 to form new words, the other player will continue to play until that player wins the game by reaching either the designated outside edge 15 of the playing board 11 depending upon the version of the game selected.

The playing board 11 can be produced from numerous materials such as paper or cardboard with the inner hexagons 13 printed on the playing board 11. As an alternative, the playing board 11 may be produced from plastic with inner hexagons 13 molded in the plastic. As still another alternative, the playing board 11 may be produced from wood with the inner hexagons being inlaid wood. The inner hexagons 13 may also be recessed and sized so that the playing pieces 29 readily fit into the recesses. The board may be magnetized and the playing pieces 29 may also be magnetized. In this way, with either the playing board 11 or the playing pieces 29 being magnetized and both the playing pieces 29 and the playing board 29 being metallic, preferably being made of steel, the playing pieces 29 will hold to the playing board 11. The inner hexagons may also be etched or painted upon the playing board.

While a preferred embodiment has been shown and described, various modifications and substitutions may be made without departing from the spirit and scope of this invention. Accordingly, it is understood that this invention has been described by way of illustration rather than limitation.

I claim:

1. A method for at least two players to play a board game having a playing board with a hexagonal configuration of six edges with three alternating edges of the six edges having one color and the other three alternative edges having a different color and having two sets of playing pieces numbering in the range of fifty to one hundred playing pieces each playing piece having a letter of the alphabet on it, including both vowels and consonants, and including bridge letters which consist of the letters I, 0, H, S, X, and Z, one set of playing pieces being designated by one color and the other set of playing pieces by another color, said method comprising:

selecting one player as the first player to proceed;

each player randomly selecting five playing pieces, the letter on each of the playing pieces so selected being unknown to the player prior to selection;

each player selecting an edge of playing board as the starting edge for that player, the edges selected for starting being opposite one another;

each player in turn placing up to five letters on the board to form a word, at least one of the letters of the word so placed initially on the playing board being located along the starting edge of the board selected by that player;

each player selecting more playing pieces up to a total of five playing pieces for each turn of that player and alternating turns at playing pieces on the board to form a chain of words, each word so placed being extended from at least one of the playing pieces previously placed upon the board by that player, both of the players being able to use a bridge letter already placed on the board by the other player, each player being permitted to form words and interlinking words, interlinking words being unintended words created by the formation of intended words, interlinking words being both all vowels and all consonants, each word placed on the board being read from left to right as viewed by that player; and the players continuing alternating turns until one of the players has constructed at least one word chain that reaches at least one predetermined edge on the playing board remote from starting edge where that player initiated play.

2. A method according to claim 1 where the players continue alternating turns until one of the players has constructed a word chain that reaches the opposite edge of the playing board from where that player initiated play.

3. A method according to claim 1 where the players continue alternating until one of the players has constructed a pair of chains each one of which reaches a different edge of the board having the same color as the starting edge.

4. A method for at least two players to play a board game having a playing board with a hexagonal configuration with six edges of substantially of the same size and contiguous to one another and with three alternating edges of the six edges having one color and the other three alternative edges having a different color and the other having two sets of playing pieces numbering in the range of fifty to one hundred playing pieces, each playing piece having a letter of the alphabet on it including both vowels and consonants, and including bridge letters which consist of the letters I, 0, H, S, X and Z, one set of playing pieces being designated by one color and the other set of playing pieces by another color, said method comprising:

placing each set of playing pieces in a container to prevent the players from being able to identify the letters on the various playing pieces;

determining by chance which player is first to place playing pieces on the playing board;

each player selecting randomly five playing pieces the letter on all five playing pieces being unknown to the player selecting such playing pieces;

returning playing pieces to their respective container and selecting randomly further playing pieces until a selection of five playing pieces is achieved with a mixture of vowels and consonants;

each player selecting an edge of the playing board as the starting edge for that player the edges selected for starting being opposite one another;

the player determined to be the first to play placing up to five letters on the board to form a word at least one of the letters of the word so placed initially on the playing board being located at the edge of the playing board selected by that player;

the player determined to be the second to play placing up to five letters on the board to form a word, at least one of the letters of the word so placed initially on the playing board being located along the starting edge of the playing board selected by the player;

each player selecting more playing pieces after returning any unused playing pieces not desired by the player up to a total of five playing pieces and alternating turns at placing playing pieces on the board to form a chain of words, each word so placed being extended from at least one of the playing pieces previously placed upon the board by that player, the players being able to use a bridge letter already placed on the board by each player being permitted to form words and interlinking words, interlinking words being unintended words created by the formation of intended words, interlinking words being both all vowels and all consonants, each word placed on the board by a player being read from left to right as reviewed by that player; and the players continuing alternating turns until one player has constructed at least one word chain that reaches a predetermined edge on the playing board remote from the starting edge where that player initiated play.

5. A method according to claim 4 where the players continue alternating turns until one of the players has constructed a word chain that reaches the opposite edge of the playing board from where that player initiated play.

6. A method according to claim 4 where the players continue alternating until one of the players has constructed a pair of chains each one of which reaches a different edge of the board having the same color as the starting edge.

* * * * *